United States Patent [19]

Enkner et al.

[11] 4,281,823

[45] Aug. 4, 1981

[54] TILTABLE CONVERTER ARRANGEMENT

[75] Inventors: Bernhard Enkner; Rupert Berger; Manfred Eysn, all of Linz; Hermann Haslehner, Alkoven; Helmut Smejkal, Linz; Michael Sattler, Ansfelden, all of Austria

[73] Assignee: Voest-Alpine Aktiengesellschaft, Linz, Austria

[21] Appl. No.: 91,268

[22] Filed: Nov. 5, 1979

[30] Foreign Application Priority Data

Nov. 27, 1978 [AT] Austria ..... 8440/78

[51] Int. Cl.[3] ..... C21C 5/50

[52] U.S. Cl. ..... 266/246

[58] Field of Search ..... 266/245, 246

[56] References Cited

U.S. PATENT DOCUMENTS

| | | | |
|---|---|---|---|
| 3,146,983 | 9/1964 | Johnson | 248/141 |
| 3,653,649 | 4/1972 | Mevissen | 266/246 |
| 3,717,333 | 2/1973 | Valdenazzi | 266/246 |

*Primary Examiner*—P. D. Rosenberg

*Attorney, Agent, or Firm*—Brumbaugh, Graves, Donohue & Raymond

[57] ABSTRACT

In a tiltable converter arrangement with a carrying ring surrounding the converter vessel at a distance and having two carrying trunnions, the converter vessel is movably connected with the carrying ring by articulately connected brackets. The converter vessel is mounted in the carrying ring by means of three of these brackets that are inclined towards the longitudinal axis of the converter vessel and whose joints are each mounted to the converter vessel and to the carrying ring. The three brackets are pivotable in the plane laid through their longitudinal or central axes and the longitudinal axis of the converter vessel, which plane is at a right angle to the axis of the carrying trunnions.

10 Claims, 8 Drawing Figures

TILTABLE CONVERTER ARRANGEMENT

BACKGROUND OF THE INVENTION

The invention relates to a tiltable converter with a carrying ring surrounding the converter vessel at a distance and comprising two carrying trunnions which are arranged diametrically opposite each other, the converter vessel being movably connected with the carrying ring by tension-and-pressure-accommodating connecting means.

A number of demands are made on the suspension of a converter vessel in its carrying ring. In the first place, the suspension has to permit deformations of the vessel as well as of the carrying ring. Such deformations, which occur due to the influence of the metallurgical operation and due to the static loads, must not be impeded, since otherwise constraining forces will occur between the converter and the carrying ring. A further demand made on a converter suspension is that no play be present between the converter vessel and the carrying ring which would allow for a relative movement of these two parts, since such a play would cause impacts during tilting of the converter and thus uncontrolled strains of the load-accommodating connecting means of the suspension.

Furthermore, the frictional forces acting against the deformations of the converter and the carrying ring are to be small. Also the load-accommodating elements should be reasonably simple to construct and to dimension, i.e. the calculation of the forces occurring at the suspension is to be feasible with the utmost accuracy.

A converter of the initially-described kind is known from German Auslegeschrift No. 1,946,892, in which, for suspending the converter vessel in the carrying ring, a ball-and-socket joint is arranged in the region of a carrying trunnion, which joint connects the carrying ring directly with the converter vessel. This ball-and socket oint, for accommodating the horizontal forces, coacts with a horizontally arranged tension rod which is provided with ball-and-socket joints at its ends, and for accommodating vertical forces, coacts with perpendicular tension rods. It is true that by this known converter suspension, only a slight resistance is offered against the deformation of the converter. Yet four load-accommodating elements are altogether necessary, which is one load element more than is necessary for a statically defined three-point suspension of the converter vessel in the carrying ring. Moreover, a three-point support is not guaranteed in every position of the converter despite the four load-accommodating elements.

SUMMARY OF THE INVENTION

The invention has as its object the provision of a converter whose suspension, in addition to meeting all of the demands pointed out above, also meets the requirement that, via a three-point support, the static definition of the support is ensured in every position of the converter, the dimensioning (i.e. the calculation of strength) is simplified, and the sensitivity of the converter to mechanical disturbances caused by the suspension is reduced.

These objects are achieved in that the converter vessel is mounted in the carrying ring by means of three brackets that are inclined towards the longitudinal axis of the converter vessel and whose joints are each articulately mounted to the converter vessel and the carrying ring. These articulate brackets are pivotable in the plane which is formed by their longitudinal or central axes and by the longitudinal axis of the converter vessel. The inclination of the articulate brackets towards the longitudinal axis of the converter vessel suitably lies within an angle range between 15° and 45°.

A preferred inclination of the longitudinal axes of each articulate bracket to the longitudinal axis of the converter is 30°.

According to a preferred embodiment, each articulate bracket is equipped with a single pivot bearing at one end and two pivot bearings at its other end, arranged at a distance from each other in the peripheral direction of the converter and the supporting ring, respectively. The ends of all of the articulate brackets comprising one pivot bearing are allocated either to the carrying ring or to the converter, and the bearings of the articulate brackets are suitably designed as articulation bearings.

When arranging two bearings at a distance from each other at the end of an articulate bracket, it is advantageous if one bearing is designed as a fixed bearing and the other bearing is designed as an expansion bearing.

A particularly suitable arrangement of the articulate brackets is characterized in that the longitudinal axes of all of the articulate brackets lie in a plane laid through the longitudinal axis of the converter vessel and at a right angle to the axis of the carrying trunnions. Advantageously two of the articulate brackets are arranged below, and one articulate bracket is arranged above, the carrying ring of the converter vessel when it is in an upright position.

BRIEF DESCRIPTION OF THE DRAWINGS

The invention will now be explained in more detail by way of several embodiments and with reference to the accompanying drawings, wherein.

DESCRIPTION OF ILLUSTRATIVE EMBODIMENTS

Figure 1:
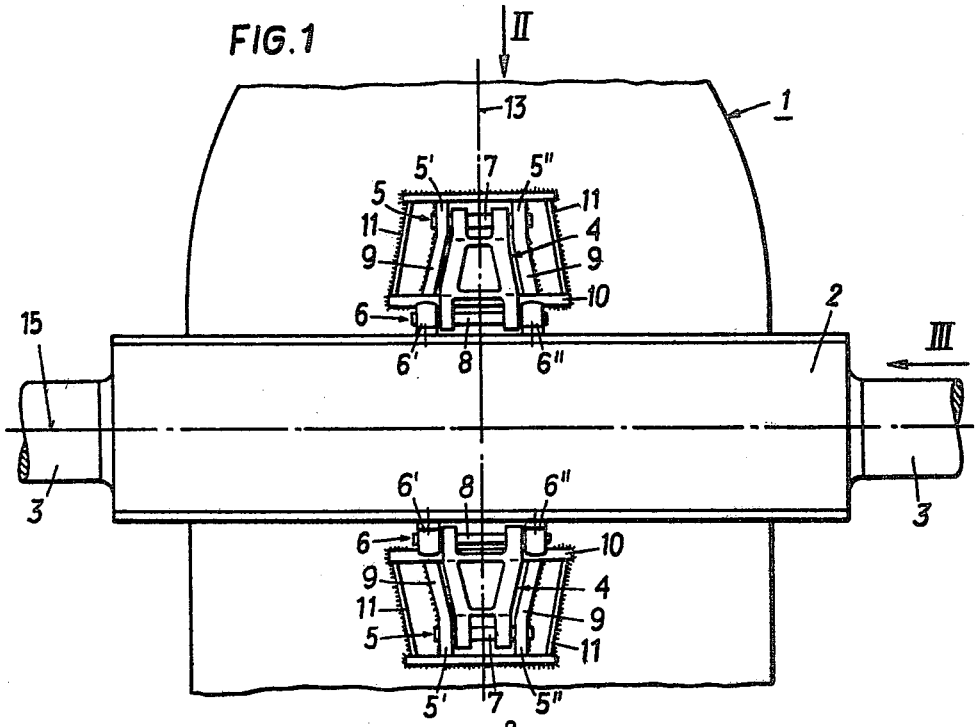
FIG. 1 is a front view of a converter.

A converter vessel, which is denoted by 1, is surrounded by a closed carrying ring 2. The carrying ring 2 is tiltably mounted in supporting bearings (not illustrated) by means of two aligning carrying trunnions 3.

Fastening of the converter vessel 1 in the carrying ring 2 is effected by means of three brackets 4, which are each articulately mounted both on the carrying ring 2 and on the converter vessel 1 in bearings 5, 6 so as to be pivotably movable. Both the bearings 6 provided on the carrying ring and the bearings 5 on the converter vessel are designed in two parts, each articulate bracket being inserted in one part 5', 5'' and 6', 6'' each, of the bearings 5, 6, by pins 7, 8 provided on their ends. The bearings 6 on the converter vessel are installed in ribs 9, which are reinforced by chords 10 and further ribs 11.

Figure 3:
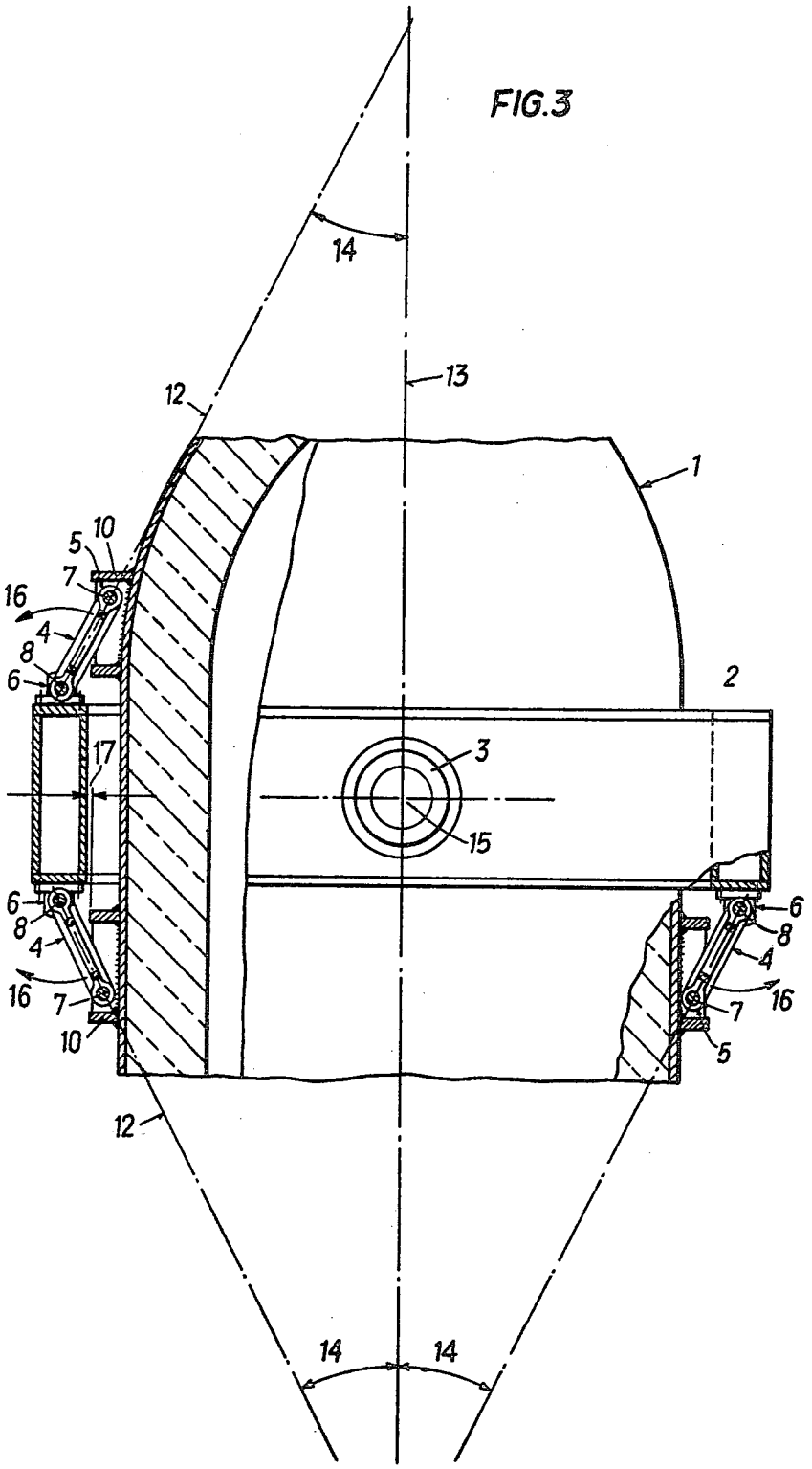
FIG. 3 is a view in the direction of the arrow III of FIG. 1, also partly sectioned.

The arrangement of the bearings 5, 6 is chosen such that the longitudinal axis or central axis 12 of each articulate bracket 4 encloses an angle 14 of approximately 30° with the longitudinal axis 13 of the converter vessel 1 (FIG. 3). The longitudinal axis 12 of each articulate bracket 4 intersects the longitudinal axis 13 of the converter vessel 1, so that the articulate brackets are pivotable in the plane formed by their longitudinal axes and the longitudinal axis of the converter vessel. Furthermore, the longitudinal axes of all of the articulate brackets lie in the plane that is laid at a right angle relative to the axis 15 of the carrying trunnion 3 and through the longitudinal axis 13 of the vessel. One of the articulate brackets 4 is arranged on the upper side of the carrying ring and the two other articulate brackets are arranged on the lower side of the carrying ring when the converter is in its upright position.

Figure 2:
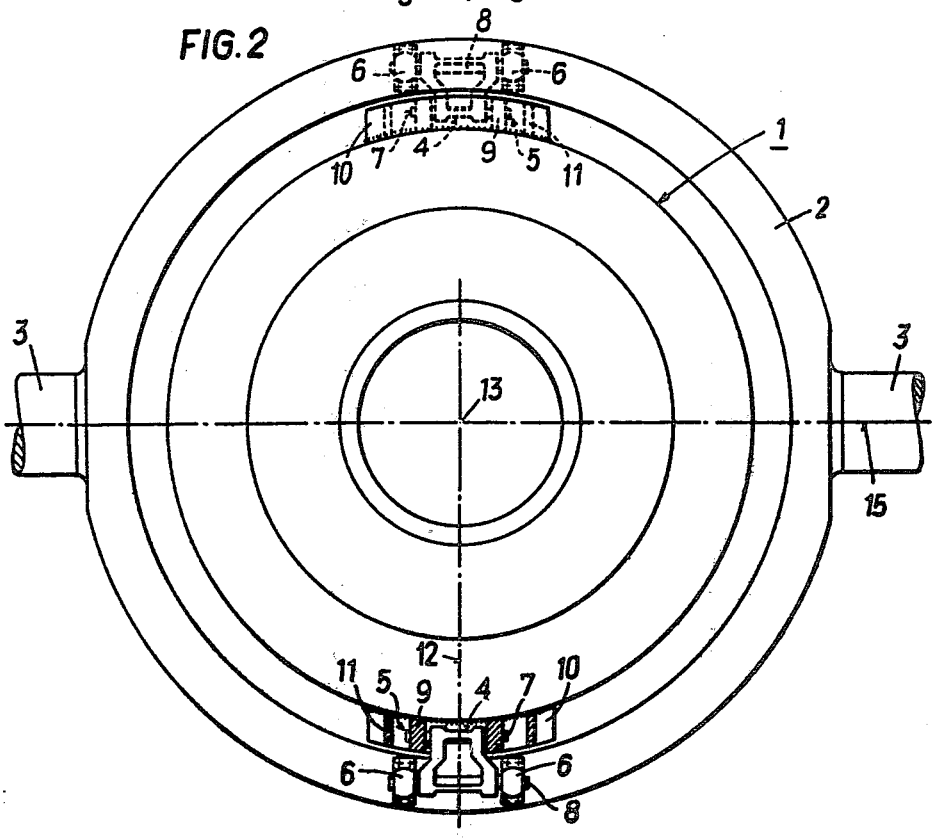
FIG. 2 is a view in the direction of the arrow II of FIG. 1, partly sectioned.

This arrangement of the articulate brackets, which can be clearly seen, particularly from FIG. 3, has the effect that the converter vessel 1 can freely expand and retract in all directions within the carrying ring with only frictional forces occurring in the bearings 5, 6 during such a deformation of the converter vessel. The weight of the converter, with the converter in the upright position as illustrated in FIGS. 1 to 3, is introduced into the carrying ring by means of the two articulate brackets 4 which are arranged on the lower side of the carrying ring 2. Upon tilting the converter vessel, the third articulate bracket 4, which is arranged on the upper side of the carrying ring 2, will start acting.

The installation into, and removal from, the carrying ring of the converter vessel is extremely simple. For removal it suffices to unlatch the connection of the articulate bracket 4 to the converter vessel 1 at the bearings 6, for instance by striking out the pins 7. The articulate brackets 4 are then pivoted in the direction of the arrow 16 and the converter vessel 1 can be removed by lifting or lowering it from the carrying ring 2, due to the play 17 provided between the carrying ring and the outermost contour of the converter.

Figure 4:
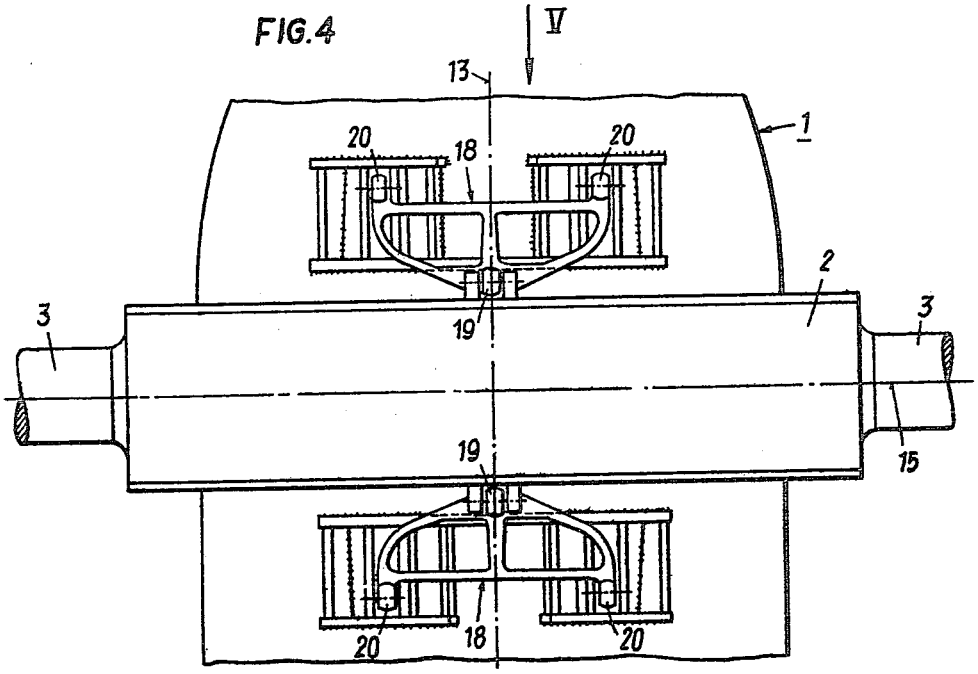
FIGS. 4 and 5, as well as FIGS. 7 and 8 illustrate two further embodiments in representations analogous to those of FIGS. 1 and 2.
Figure 5:
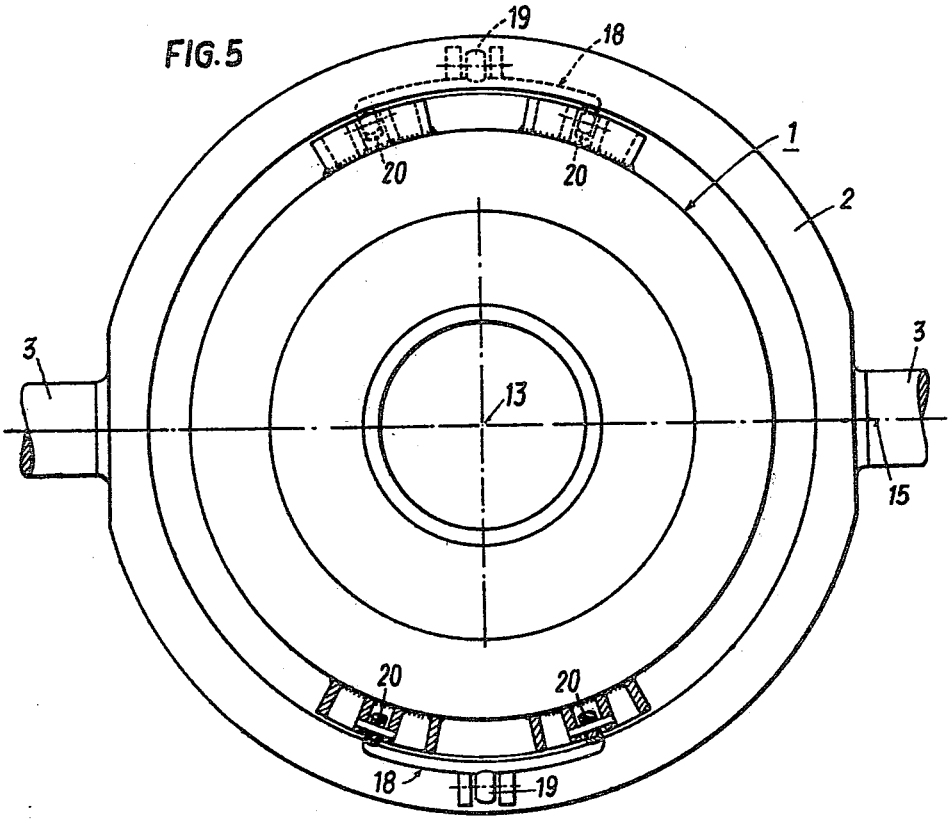
Figure 6:
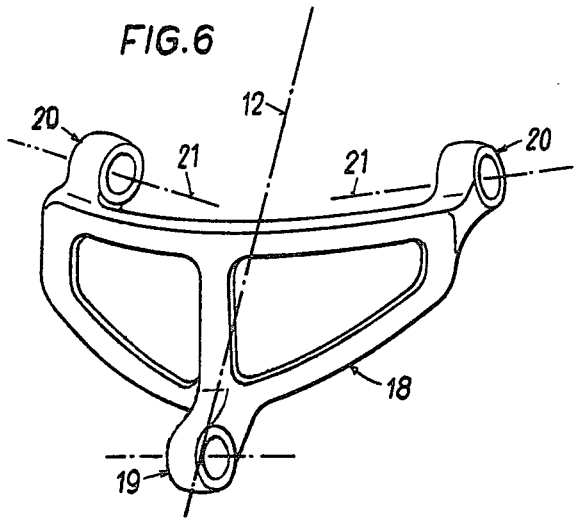
FIG. 6 shows an articulate bracket for the embodiment illustrated in FIGS. 4 and 5, in an oblique projection.

In the embodiment illustrated in FIGS. 4 to 6, articulate brackets 18 which are designed in a cranked manner relative to their longitudinal (or central) axis 12 are each mounted on the carrying ring 2 by means of a bearing 19, and on the converter vessel by means of two spaced-apart bearings 20. Due to the great distance between the two bearings 20 that are arranged on the converter vessel, the axes 21 of these bearings enclose an obtuse angle with each other. These bearings 20 are designed as articulation bearings as schematically illustrated in FIG. 5. Thereby, problem-free pivoting of the articulate brackets about these bearings 20 is made possible. One of the articulation bearings 20 is designed as an expansion bearing and the other one is designed as a fixed bearing.

Figure 7:
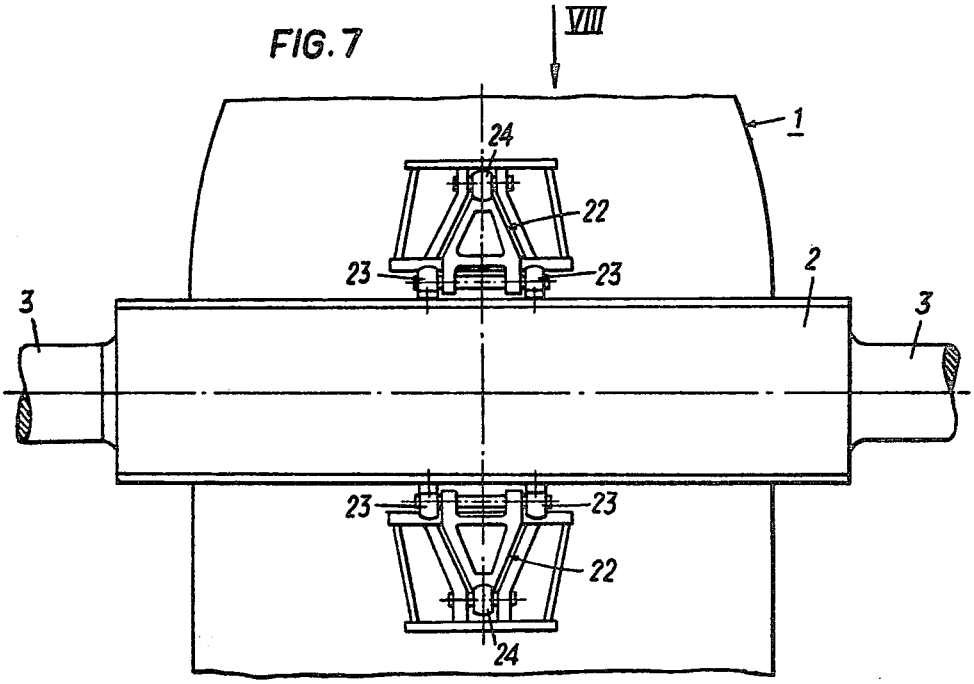
Figure 8:
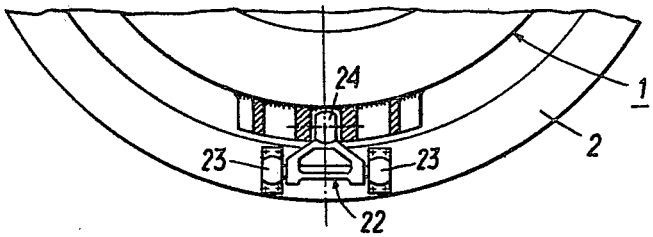

A further embodiment is represented in FIGS. 7 and 8, in which each articulate bracket 22 is mounted on the carrying ring 2 by means of two spaced-apart bearings 23 and on the converter vessel by means of a single bearing 24.

The invention is not limited to the embodiments illustrated, but can be modified in various aspects. Thus, it is also possible to arrange the articulate brackets beyond the symmetrical plane laid perpendicularly to the axis of the carrying trunnion, for instance would it be possible for all three articulate brackets to be arranged only on the upper side or only on the lower side of the carrying ring, and evenly distributed about the same.

What we claim is:

1. In a tiltable converter arrangement of the type including a converter vessel, a carrying ring surrounding said converter vessel at a distance and having two diametrically oppositely arranged carrying trunnions, and a plurality of brackets articulately mounted on both said converter vessel and said carrying ring, the improvement which comprises three brackets for articulately mounting said converter vessel in said carrying ring, each of said three brackets being inclined towards the longitudinal axis of said converter vessel and having joints mounted on said converter vessel and further joints mounted on said carrying ring, and wherein the longitudinal axes of said three brackets lie in a plane laid through the longitudinal axis of said converter vessel and at a right angle relative to the axis of said carrying trunnions, and said three brackets are pivotable in a plane formed by the longitudinal or central axes of said three brackets and the longitudinal axis of said converter vessel.

2. A tiltable converter arrangement as set forth in claim 1, wherein said three brackets are inclined towards the longitudinal axis of said converter vessel in an angle region of between 15° and 45°.

3. A tiltable converter arrangement as set forth in claim 1, wherein the longitudinal axis of each of said three brackets encloses an angle of approximately 30° with the longitudinal axis of said converter vessel.

4. A tiltable converter arrangement as set forth in claim 1, wherein each one of said three brackets has a first end and a second end, a single pivot bearing being provided on said first end and two pivot bearings on said second end, which two pivot bearings are arranged at a distance from each other in the peripheral direction of said converter vessel and said carrying ring, the first ends of all of said articulate brackets being allocated to said carrying ring.

5. A tiltable converter arrangement as set forth in claim 1, wherein each one of said three brackets has a first end and a second end, a single pivot bearing being provided on said first end and two pivot bearings on said second end, which two pivot bearings are arranged at a distance from each other in the peripheral direction of said converter vessel and said carrying ring, the first ends of all of said articulate brackets being allocated to said converter vessel.

6. A tiltable converter arrangement as set forth in claim 1, wherein said three brackets have bearings, of which at least some are articulation bearings.

7. A tiltable converter arrangement as set forth in claim 4 or 5, wherein said two pivot bearings provided at said second end are articulation bearings.

8. A tiltable converter arrangement as set forth in claim 4 or 5, wherein said two pivot bearings provided at said second end are articulation bearings, one of said two pivot bearings being designed as a fixed bearing and the second one as an expansion bearing.

9. A tiltable converter arrangement as set forth in claim 4 or 5, wherein one of said two pivot bearings provided at said second end is a fixed bearing and the other one of said two pivot bearings is an expansion bearing.

10. A tiltable converter arrangement as set forth in claim 1, wherein two of said three brackets are arranged below said carrying ring and one of said three brackets is arranged above said carrying ring, when said converter vessel is in an upright position.

* * * * *